US008299872B2

(12) United States Patent
Di et al.

(10) Patent No.: US 8,299,872 B2
(45) Date of Patent: Oct. 30, 2012

(54) ULTRA WIDE-BAND DUAL-FREQUENCY COMBINER

(75) Inventors: Yingjie Di, Guangzhou (CN); Tao He, Guangzhou (CN); Bin He, Guangzhou (CN); Mengmeng Shu, Guangzhou (CN); Jingmin Huang, Guangzhou (CN)

(73) Assignee: Comba Telecom System (China) Ltd. (CN)

( * ) Notice: Subject to any disclaimer, the term of this patent is extended or adjusted under 35 U.S.C. 154(b) by 531 days.

(21) Appl. No.: 12/668,290

(22) PCT Filed: Apr. 11, 2007

(86) PCT No.: PCT/CN2007/001162

§ 371 (c)(1),
(2), (4) Date: Jan. 8, 2010

(87) PCT Pub. No.: WO2008/110041

PCT Pub. Date: Sep. 18, 2008

(65) Prior Publication Data

US 2010/0244982 A1 Sep. 30, 2010

(30) Foreign Application Priority Data

Mar. 12, 2007 (CN) ..... 2007 1 0027110

(51) Int. Cl.
*H01P 1/20* (2006.01)
*H01P 7/04* (2006.01)

(52) U.S. Cl. ..... 333/134; 333/206

(58) Field of Classification Search ..... 333/134, 333/132, 135, 202, 203, 206, 207
See application file for complete search history.

(56) References Cited

U.S. PATENT DOCUMENTS

| | | | | |
|---|---|---|---|---|
| 4,091,344 | A * | 5/1978 | LaTourrette | 333/134 |
| 6,892,056 | B1 | 5/2005 | Garmonov et al. | |
| 6,919,782 | B2 * | 7/2005 | Sauder et al. | 333/202 |
| 8,174,340 | B2 * | 5/2012 | Vangala et al. | 333/134 |

FOREIGN PATENT DOCUMENTS

| | | | |
|---|---|---|---|
| CN | 1365582 | A | 8/2002 |
| CN | 2595111 | Y | 12/2003 |
| CN | 2657318 | Y | 11/2004 |
| EP | 1569333 | A1 | 8/2005 |

OTHER PUBLICATIONS

International Search Report, PCT/CN2007/001162, dated Dec. 20, 2007.

* cited by examiner

*Primary Examiner* — Stephen Jones
(74) *Attorney, Agent, or Firm* — Lerner, David, Littenberg, Krumholz & Mentlik, LLP

(57) ABSTRACT

An ultra wideband dual-frequency combiner includes a combination port (Port 1), a first port (Port 2), a second port (Port 3), two coaxial resonator band pass filters and two direct current channels. The first direct current channel is connected between the first port (Port 2) and the combination port (Port 1). The second direct current channel is connected between the second port (Port 3) and the combination port (Port 1). One end of the first coaxial resonator hand pass filters (610, 611) is electrically connected with the first port (Port 2) via a first blocking capacitor. One end of the second coaxial resonator hand pass filter (620, 621) is electrically connected with the second port (Port 3) via a second blocking capacitor. The other ends of the first coaxial resonator band pass filter and the second coaxial resonator band pass filter are connected with the combination port (Port 1) via a third blocking capacitor. The blocking capacitors are parameter distributed capacitors.

10 Claims, 4 Drawing Sheets

ULTRA WIDE-BAND DUAL-FREQUENCY COMBINER

CROSS REFERENCE TO RELATED APPLICATIONS

The present application is a national phase entry under 35 U.S.C. §371 of International Application No. PCT/CN2007/001162, filed Apr. 11, 2007, published in Chinese, which claims the benefit of Chinese Patent Application No. 200710027110.7, filed Mar. 12, 2007. The disclosures of said applications are incorporated by reference herein.

FIELD OF THE INVENTION

The present invention generally relates to processing devices for combining the second generation communication system with the third generation communication system and, more specifically, to an ultra wideband dual-frequency combiner.

BACKGROUND OF THE INVENTION

With the rapid development of mobile communication, application ways of multi-system with co-base station and shared antenna feeder are widely used at present, to share resources and reduce cost of the system device. Dual-frequency combiner is a necessary microwave device in shared antenna feeder system of 2G/3G. The combiner is used for combining and distributing the different systems, to save feed cables, simplify system and reduce cost. Additionally, the power supply of the device in the base station tower is realized by the radio frequency cable. The combiner connected in series with the feed cable should have the performance of transmitting direct current power.

Referring to the schematic diagram of FIG. 1, the combiner is a microwave device with three ports, including two direct current feed channels and two radio frequency signal channels. Each of the direct current teed channels includes a lumped parameter low-pass filter, a switch and a lightning protection device. The low-pass filter is used for suppressing high frequency radio frequency signal so that the control signals with pre-determined frequency (for example, 3 MHz) can pass therethrough. The switch is used for controlling the direct current power to pass or not. The radio frequency signal channel includes a band-pass titter and a blocking capacitor. Pass band range of the band-pass filter of two radio frequency signal channels is adapt to the frequency range of the two combined signals. The signal input from public port (Port 1) is distributed to Port 2 or Port 3. Contrarily, the signal input from Port 2 or Port 3 are combined and output from Port 1.

The frequency range of the radio signal in the 2G/3G antenna feeder system is 806 MHz-960 MHz and 17101 MHz-21700 MHz. Most of the current combiner products realize the performance of ultra wide band and direct current passing by microstrip circuit with dielectric substrate. The disadvantages of these products are large volume and small power capacity. Additionally, the passive intermodulation index is determined by characters or the dielectric substrate material and, therefore, it is difficult to control in mass production.

SUMMARY OF THE INVENTION

Therefore, the object of the present invention is to provide an ultra wideband dual-frequency combiner which has the performance of small size, small signal loss, large power capacity, as well as high isolation between direct current channel and radio frequency signal channel.

According to one embodiment of the present invention, an ultra wideband dual-frequency combiner includes a combination port, a first port for receiving a first frequency band, a second port for receiving a second frequency band, two coaxial resonator band pass filters, and two direct current channels. The first direct current channel is connected between the first port and the combination port. The second direct current channel is connected between the second port and the combination port. One end of the first coaxial resonator band pass filler is electrically connected with the first port through a first blocking capacitor. One end of the second coaxial resonator band pass filter is electrically connected with the second port through a second blocking capacitor. The other ends of the first coaxial resonator band pass filter and the second coaxial resonator band pass filter are connected with the combination port through a third blocking capacitor. The blocking capacitors are parameter distributed capacitors.

Preferably, the first and the second coaxial resonator band pass filters each includes a coaxial cavity and a number of resonant columns defined one by one in the coaxial cavity. A spinal column is defined between two adjacent resonant columns of two coaxial resonator band pass filters for strengthening coupling effects.

Preferably, the blocking capacitor includes an inner conductor, an insulator and a sleeve. The insulator is sot outside of the inner conductor. The sleeve is seated outside of the insulator. The sleeve is used for electrically connecting with the first coaxial resonator hand pass filter and/or the second coaxial resonator hand pass filter. The inner conductor is used for electrically connecting with the first direct current circuit and/or the second direct current circuit, thereby connecting to the adjacent parts.

Preferably, the first coaxial resonator band pass filter defines five resonant columns and the second coaxial resonator band pass filter defines six resonant columns.

Preferably, the first direct current channel includes a first low-pass filter electrically connected with the inner conductor of the first blocking capacitor. The second direct current channel includes a second low-pass filter electrically connected with the inner conductor of the second blocking capacitor. The first direct current channel and the second direct current channel each include a third low-pass filter electrically connected with inner conductor of the third blocking capacitor.

Preferably, the first and the second coaxial resonator hand pass filter are disposed in a box. The box includes a housing, a board and a cover. The housing defines two coaxial resonator band pass filters divided by a metal plate. The combination port, the first port and the second port are arranged outside of the housing. The blocking capacitors are defined in the coaxial cavities of two coaxial resonator band pass filters. The board is fixed on the housing. The first and second direct-current channel is defined in the board, wherein low-pass filters of the first and the second direct-current channels is fixed at the edge of top surface of the coaxial cavity by the support part. The cover is fixed to the housing.

Preferably, the board corresponding to two coaxial resonator band pass filter defines a number of tuning screws extending through the board into two coaxial cavities. The tuning screws are used for adjusting resonant frequency and coupling capacity of two coaxial resonator band pass filter.

Preferably, a gap which is not less than 0.2 mm is defined between upper surface of the board and the support parts. Surface of the board is provided with holes and gore breathable membranes covers the holes.

Compared with the conventional technique, the present invention at least has the following advantages: 2G/3G ultra wideband dual-frequency combiner realized by the coaxial resonator band pass filters in accordance with the present invention realizes the mutual isolation of direct current channel and radio frequency signal channel by a special way. Parameter distributed capacitors can reduce the size of the product using the ultra wideband dual-frequency combiner in accordance with the present invention. Moreover, ultra wideband dual-frequency combiner according to the present invention has a redesigned configuration, so as to achieve the advantages of small signal loss, large power capacity and high isolation between the channels.

DETAILED DESCRIPTION OF THE INVENTION

Reference will now be made to the drawings to describe an embodiment of the present invention in detail.

Figure 2:
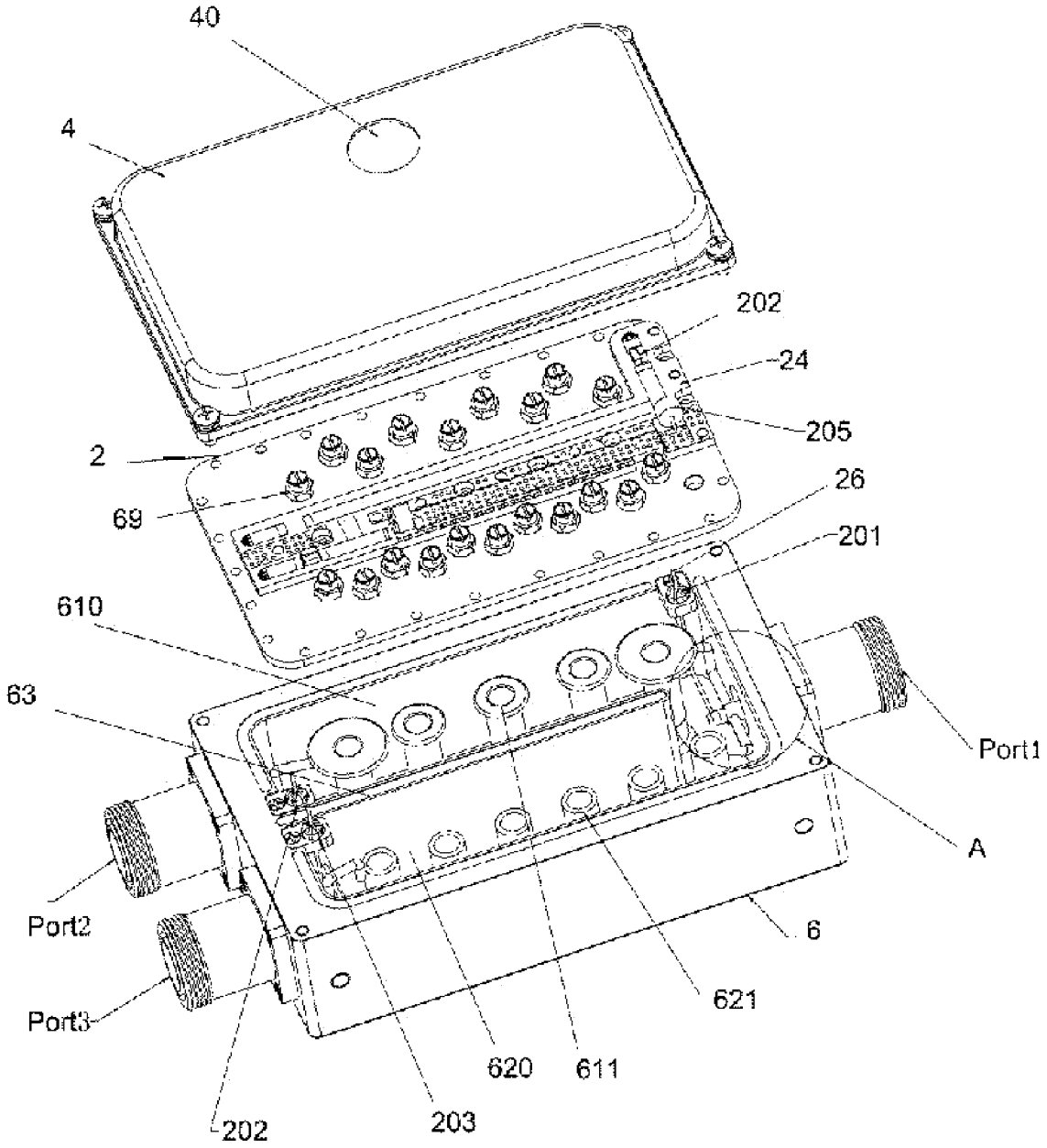
FIG. 2 is an isometric view of a combiner in accordance with the present invention.
Figure 3:
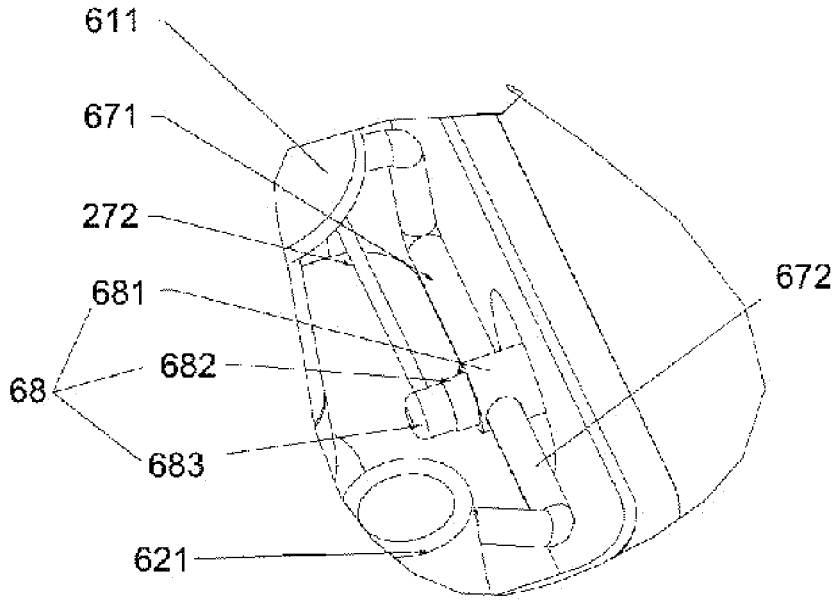
FIG. 3 is an enlarged view of part A in FIG. 2.

Referring to FIG. 2, an ultra wide band double frequency combiner of the invention is mainly used for combining 2G signals and 3G signals.

As shown in FIG. 2, the combiner is generally a box including a housing 6, a board 2 and a cover 4.

A first port (Port 2) and a second port (Port 3) are defined at the left side of the housing 6 to receive radio frequency signal with 806-960 MHz and 1710-2170 MHz, respectively. A combination port (Port 1) is defined at the right side of the housing 6 for outputting a radio frequency signal which is combined radio frequency signal from the first port (Port 2) and the radio frequency signal from the second port (Port 3), or for inputting shunt signal to the first port (Port 2) and the second port (Port 3).

Two radio frequency channels, namely the first radio frequency channel and the second radio frequency channel, are integrated into the housing 6. The first radio frequency channel includes a first port (Port 2), a first blocking capacitor (not shown in any figures, referring to the third blocking capacitor 68), a coaxial resonator band pass filter 610, 611, a third blocking capacitor 68 as well as the combination port electrically connected in sequence. The second radio frequency channel includes a second port (Port 3), a second blocking capacitor (not shown in any figures, referring to the third blocking capacitor 68), a coaxial resonator band pass filter 620, 621, the third blocking capacitor 68 and the combination port that are electrically connected in sequence.

It can be clearly seen that each radio frequency channels includes a coaxial resonator band pass filter. The two radio frequency channels share the third blocking capacitor 68.

Each coaxial resonator band pass filter includes a coaxial cavity and a number of resonant columns 611, 621. As shown in FIG. 2, the cavity in the middle of the housing 6 is divided into two coaxial cavities by a metal plate 63, a first coaxial cavity 610 corresponding to the first radio frequency channel and a second coaxial cavity 620 corresponding to the second radio frequency channel. The metal plate 63 provides pretty good isolation between the first and the second radio frequency channel. Five resonant columns 611 are defined in the first coaxial cavity 610 one by one. A resonant column nearest to the first port (Port 2) connects to the first blocking capacitor via electrical wires, and electrically connects to the first port (Port 2) subsequently. A last resonant column at the other end connects to the third blocking capacitor 68 via electrical wires. Similarly, six resonant columns 621 are defined in the second coaxial cavity 610 one by one. A resonant column nearest to the second port (Port 3) connects to the second blocking capacitor via electrical wires and electrically connects to the second port (Port 3) subsequently. A last resonant column at the other end connects to the third blocking capacitor 68 via electrical wires.

The metal plate 63 between the two coaxial resonator band pass filters does not make the two coaxial cavities 610, 620 separate from each other completely.

The first and second blocking capacitor have same configuration as the third blocking capacitor 68, including an inner conductor 683, an insulator 682 and a sleeve 681. The inner conductor 683 is set in the insulator 682, and the insulator 682 is set in the sleeve 681. The insulator 682 achieves isolation performance via a medium film. The sleeve 681 connects to the last resonant columns of the first and the second coaxial resonator band pass filter 610, 611, 620, 621 simultaneously. The inner insulator 683 connects to the combination port (Port 1) directly. Therefore, the sleeve 681 is insulated from the inner conductor 683 via the insulator 682, so as to form parameter distributed capacitors. For the two radio frequency channels, the radio frequency signal is transmitted via coupling of the inner conductor 683 and the sleeve 681, while the direct-current can not be transmitted via the sleeve 681. Therefore the radio frequency channel blocks the direct-current.

As described before the first and the second blocking capacitors have same configuration as the third blocking capacitor 68. A sleeve of the first blocking capacitor (not shown in figures) is only connected to the resonant column of the first coaxial resonator band pass filter which is near to the second blocking capacitor. A sleeve of the second blocking capacitor (not shown in figures) is connected to the resonant column of the second coaxial resonator hand pass filter adjacent the first blocking capacitor.

The inner conductor of each blocking capacitor extends out of the port thereof and electrically connects to corresponding port.

Figure 1:
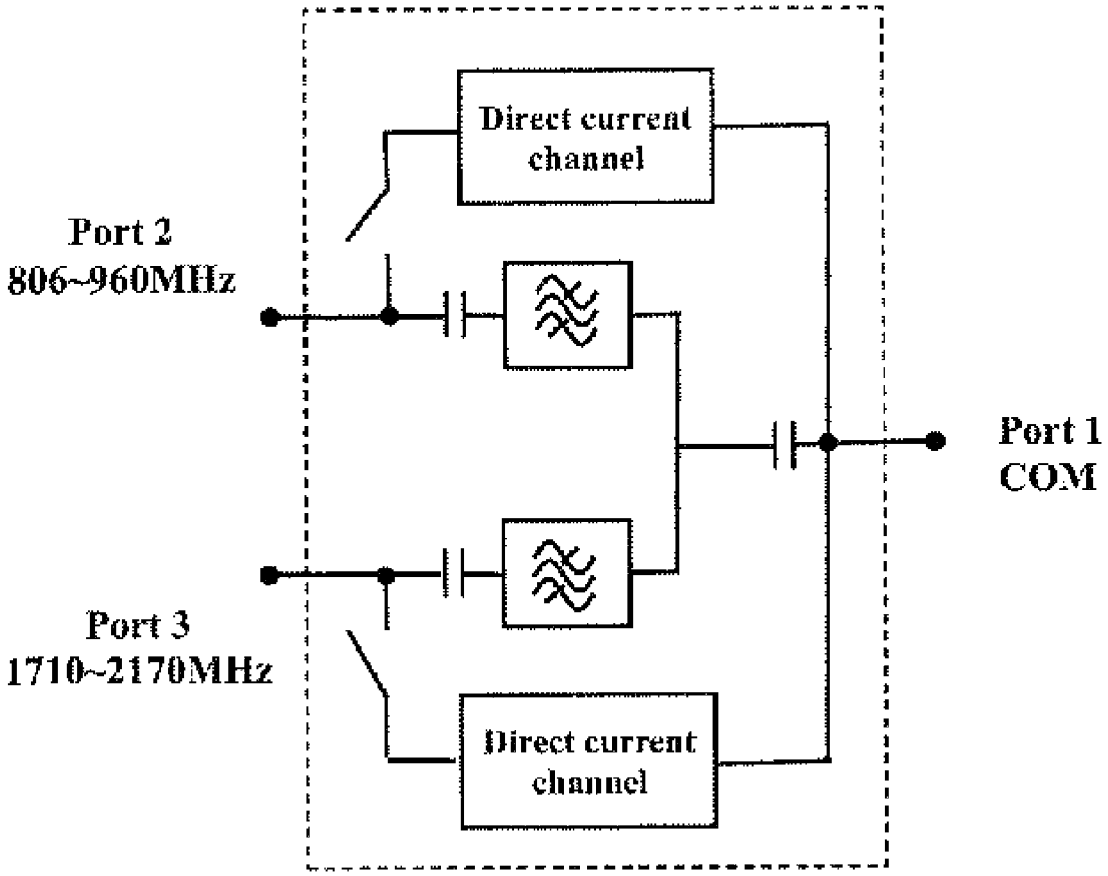
FIG. 1 is a schematic diagram of the present invention.
Figure 6:
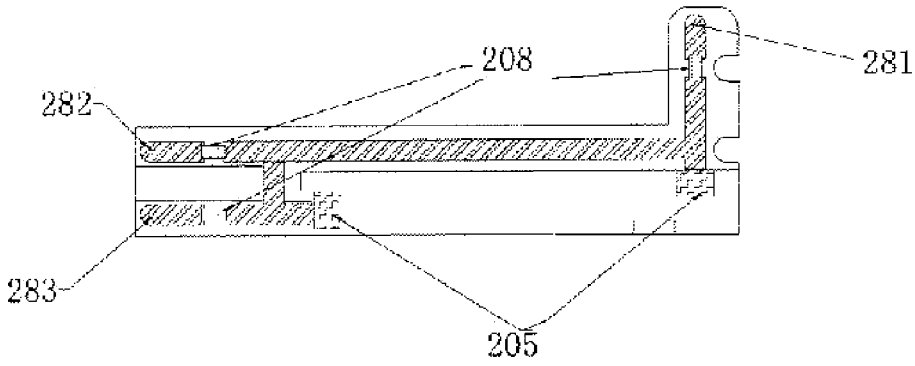
FIG. 6 is a schematic view of a direct current channel hoard of the board in FIG. 2.

A printed circuit hoard having a circuit as shown in FIG. 6 printed thereon is fixed on the board 2. The board 2 covers top surface of the two coaxial cavities 610, 620 of the housing 6. The direct-current channel technology of the double frequency combiner is known in the art and only a brief description is made below:

Referring to FIG. 1 and FIG. 6, the board 2 integrates two direct current channels, i.e. a first direct current channel and a second direct current channel. The direct current channels each include low-pass filters 201, 202, 203, a switch and lightning protection device 205. The first/second direct current channels output signals from the first/second port (Port 2). The first/second low-pass filters filter the signals, synthesize the signals and output the signals to the third low-pass filter 201. The third low-pass filter 201 outputs the signals to the combination port (Port 1). The low-pass filters 201, 202, 203 are used for blocking high-frequency signals and passing control signals which is less than 3 MHz. Additionally, a switch can be arranged between two direct current channels according to actual requirement, for controlling the direct current power to pass or not. The lightning protection device 205 can be arranged between two direct current channels if needed.

FIG. 6 shows access points 281, 282, 283 of the three low-pass filters 201, 202, 203 defined in three support parts independently. Referring to FIG. 1, three support parts are respectively defined at open edges of two coaxial cavities 610 and 620, and are near to Port 1, Port 2 and Port 3. Each support part defines the low-pass filters 201, 202, 203.

On end of the low-pass filters 201, 202, 203 is electrically connected with blocking capacitors of the Port 1, Port 2, Port 3 which are near to the low-pass filters 201, 202, 203. Specially, the end of the third low-pass filter 201 is electrically connected with the inner conductor 683 of the third blocking capacitor 68. The end of the first low-pass filter 202 is electrically connected to the inner conductor of the first blocking capacitor (not shown in the figures). The end of the second low-pass filter 203 is electrically connected with the inner conductor of the second blocking capacitor (not shown in the figures). The other end of the low-pass filters 201, 202, 203 defines contact points 26 which touch with the access points 281, 282, 283 in FIG. 6. The board 2 defines three openings corresponding to the three contact points 26. Three openings of the board 2 assemble with three contact points 26, which realizes fixation of the board 2 and housing 6. When three access points 281, 282, 283 shown in FIG. 6 connect with the contact points 26 of the three low-pass filters 201, 202, 203 in three support parts the low-pass filters 201, 202, 203 successfully connect the direct current channels. The gaps which is not less than 0.2 mm is arranged between upper surface of the board and the support parts, which ensures good electrical properties of the radio frequency signal.

The switch is realized by magnetic beads 208 welded to the circuit, so as to block high frequency signal. The connection is disconnected by removing the magnetic beads 208 and connected by replacing the magnetic beads 208.

Referring to FIG. 2, the first low-pass filter 201 is connected with the inner conductor 683 of the third blocking capacitor 68 via the lead 272, and subsequently is electrically connected with the combination port (Port 1). The second low-pass filter 202 and the third low-pass filter 203 have the same connection manner. The technical problem that the direct current channel and the radio frequency channel both connected to the combination port (Port 1) is solved.

Referring to FIG. 1, two sides of the board 2 which corresponding to two coaxial resonator band pass filter (610 and 611, 620 and 621) of the housing 6 define a number of tuning screws 69. The side corresponding to the first coaxial resonator band pass filter 610 and 611 defines nine tuning screws 69, and the other side defines eleven tuning screws 69. The tuning screws 69 extend through the board 2. When the board 2 is fixed on the housing 6, the tuning screws 69 extend into two coaxial cavities 610 and 620. The tuning screws 69 are used to adjust resonant frequency and coupling capacity of two coaxial resonator band pass filter (610 and 611, 620 and 621).

Figure 4:
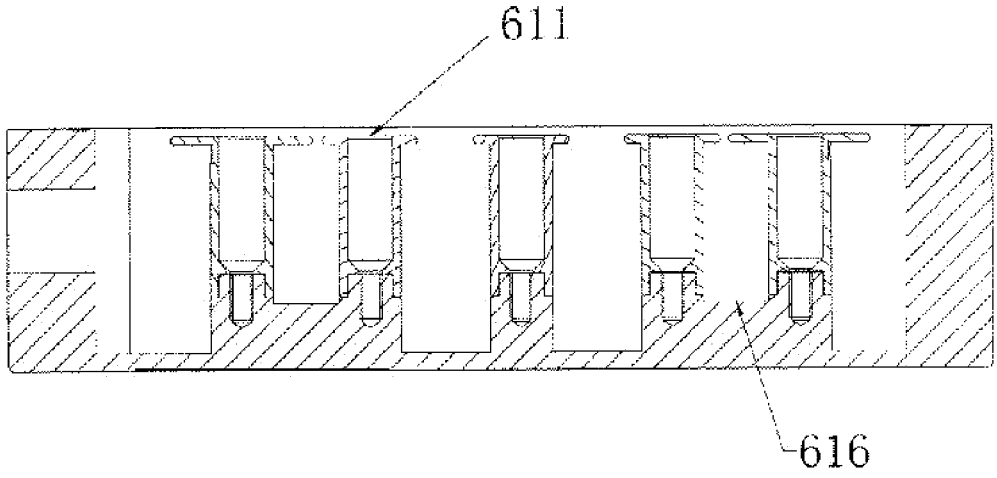
FIG. 4 is a cross-section view of the first coaxial resonator band pass filter as shown in FIG. 2.

FIG. 4 is cross-section view of the first coaxial resonator band pass filters 610 and 611 in FIG. 1, showing the first radio channel between the first port (Port 2) and the combination port (Port 1). For strengthening coupling between the resonant columns 611, spinal columns 616 are defined between the two adjacent resonant columns 611. Height of the resonant columns 611 is different, and can be adjusted according to actual requirements. Top or the resonant column 611 define a disc. There is an appropriate gap between the resonant column 611 and the board 2. The gap is preferably not less than 1.5 mm. These technical features make the resonant 611 works in the range of 806-960 MHz and size of the coaxial cavities 610 as small as possible.

Figure 5:
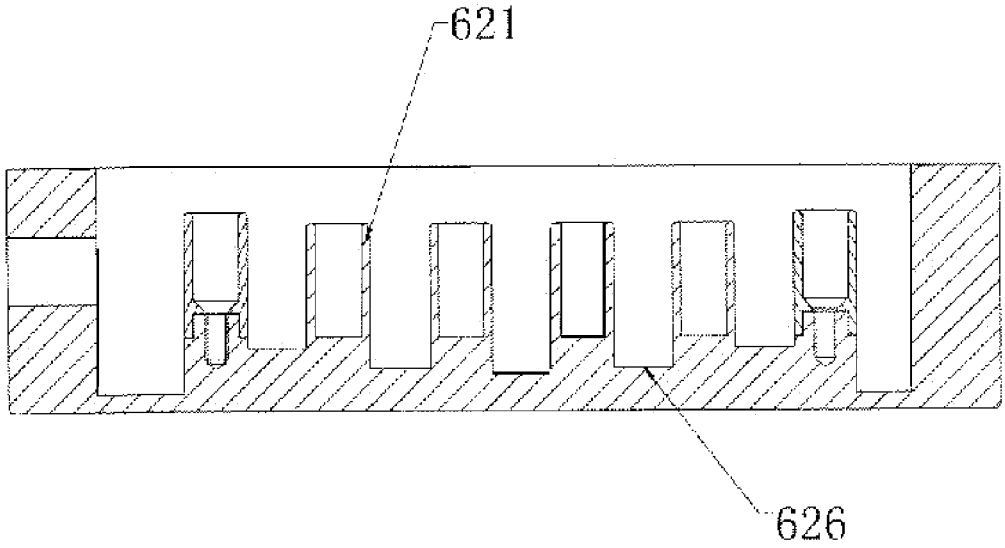
FIG. 5 is cross-section view of the second coaxial resonator band pass filter as shown in FIG. 2.

FIG. 5 is a cross-section view of the second coaxial resonator band pass filters 620 and 621 in FIG. 1, showing the second radio channel between the third port (Port 3) and the combination port (Port 1). Similarly the different height spinal columns 626 are defined between the resonant columns 621 to strengthen coupling between the resonant columns 621. The resonant column 611 works in the range of 1710-2170 MHz.

Referring to FIG. 2, the cover 4 is covered with the housing 6 for protecting the components inside. Peripheral of the cover 4 is stamped aprons, so as to strength the waterproof property and protect the inside circuit. Surface of the board 2 defines holes. Gore breathable membranes 40 are set in the holes. The gore breathable membranes 40 are used for keeping the pressure balance inside and outside of the housing 6.

Additionally, silver is plated on inside surface of two coaxial cavities 610 and 620, which decreases attenuation of the radio frequency signal during transmission, and makes insertion loss of the passband signals be less than 02.dB.

In view of the above, the present invention can overcome the shortages in the prior art and at least has the following technical effects:

Small size: Size of the combiner can be reduced to 174 mm*105 min*61 mm. The telescopic coupling structure sufficiently makes use or space of the inner conductor of the combination port (Port 1) through inner surface of the housing, which realizes coupling of the radio frequency signal and occupy no extra space. The lumped parameter low-pass filter is added into the direct current feed channel and the radio frequency signal channel, which ensures isolation between the direct current feed channel and the radio frequency signal channel and greatly reduces size of the Printed Circuit Board (PCB) of the board.

High isolation: each radio frequency channel is a closed waveguide cavity structure, which improve the isolation between the channels. The isolation that the first port (Port 2) isolates 1710-2170 MHz band radio frequency signal is more than 85 dB, and the isolation that the second port (Port 3) isolates 806-960 MHz band radio frequency signal is more than 65 dB.

Large power capacity: there are sufficient gaps between the resonant volume inside the coaxial cavity and the coaxial cavity wall, which improves the withstanding capacity of radio frequency signal of the device, and each port withstands the average power up to 250 watts.

The invention claimed is:

1. An ultra wideband dual-frequency combiner, comprising:

a combination port, a first port for receiving a first frequency band, a second port for receiving a second frequency band, two coaxial resonator band pass filters, and two direct current channels, wherein the first direct current channel is connected between the first port and the combination port; the second direct current channel is connected between the second port and the combination port; one end of the first coaxial resonator band pass filter is electrically connected with the first port via a first blocking capacitor; one end of the second coaxial resonator band pass filter is electrically connected with the second port via a second blocking capacitor; the other end of the first coaxial resonator band pass filter and the second coaxial resonator band pass filter are connected to the combination port via a third blocking capacitor; and the blocking capacitors are parameter distributed capacitors.

2. The ultra wide band dual-frequency combiner of claim 1, wherein each of the first and the second coaxial resonator band pass filters comprises a coaxial cavity and a plurality of resonant columns defined one by one in the coaxial cavity.

3. The ultra wide band dual-frequency combiner of claim 2, wherein a spinal column is defined between two adjacent resonant columns of two coaxial resonator band pass filter for strengthening coupling effects.

4. The ultra wide band dual-frequency combiner of claim 3, wherein each blocking capacitor comprises an inner conductor, an insulator and a sleeve, the insulator is set outside of the inner conductor, the sleeve is set outside of the insulator, the sleeve is configured for electrically connecting with the first coaxial resonator band pass filter and/or the second coaxial resonator band pass filter, the inner conductor is configured for electrically connecting with the first direct current channel and/or the second direct current channel, thereby connecting to adjacent ports.

5. The ultra wide band dual-frequency combiner of claim 4, wherein the first coaxial resonator band pass filter defines five resonant columns, and the second coaxial resonator band pass filter defines six resonant columns.

6. The ultra wideband dual-frequency combiner of claim 4, wherein the first direct current channel comprises a first low-pass filter electrically connected to the inner conductor of the first blocking capacitor, the second direct current channel comprises a second low-pass filter electrically connected with the inner conductor of the second blocking capacitor, and the first direct current channel and the second direct current channel each comprises a third low-pass filter electrically connected with the inner conductor of the third blocking capacitor.

7. The ultra wide band dual-frequency combiner of claim 6, wherein the first and the second coaxial resonator band pass filter is arranged in a box comprising a housing, a board and a cover; the housing defining two coaxial resonator band pass filters divided by a metal plate; the combination port, the first port and the second port are arranged outside of the housing; the blocking capacitors are defined in the coaxial cavities of two coaxial resonator band pass filters; the board is fixed on the housing; the first and the second direct-current channels are defined in the board, wherein low-pass filters of the first and the second direct-current channels are fixed at the edge of top surface of the coaxial cavity by a support part; and the cover is fixed to the housing.

8. The ultra wide band dual-frequency combiner of claim 7, wherein the board defines a plurality of tuning screws extending through the board into two coaxial cavities corresponding to the two coaxial resonator band pass filter; the tuning screws are used for adjusting resonant frequency and coupling capacity of two coaxial resonator band pass filters.

9. The ultra wide band dual-frequency combiner of claim 8, wherein a gap which is not less than 0.2 mm is arranged between an upper surface of the board and the support part.

10. The ultra wide band dual-frequency combiner of claim 9, wherein a surface of the board is provided with holes and with Gore breathable membranes covering the holes.

* * * * *

UNITED STATES PATENT AND TRADEMARK OFFICE

CERTIFICATE OF CORRECTION

PATENT NO. : 8,299,872 B2
APPLICATION NO. : 12/668290
DATED : October 30, 2012
INVENTOR(S) : Yingjie Di et al.

It is certified that error appears in the above-identified patent and that said Letters Patent is hereby corrected as shown below:

Title Page, Item (57), line 8 of the Abstract, "hand" should read --band--.
At line 11 of the Abstract, "hand" should read --band--.

IN THE SPECIFICATION:

Column 1, line 46 "titter" should read --filter--.
Column 2, line 27 "sot" should read --set--.
Column 2, line 31 "hand" should read --band--.
Column 2, line 47 "hand" should read --band--.
Column 3, line 25 "hoard" should read --board--.
Column 4, line 43 "hand" should read --band--.
Column 4, line 48 "hoard" should read --board--.
Column 5, line 10 "On" should read --One--.
Column 5, line 65 "or" should read --of--.

Signed and Sealed this
First Day of July, 2014

Michelle K. Lee

Michelle K. Lee
*Deputy Director of the United States Patent and Trademark Office*